United States Patent [19]

Pinson

[11] 4,422,427

[45] Dec. 27, 1983

[54] FUEL MANAGEMENT SYSTEM FOR AN AUTONOMOUS MISSILE

[75] Inventor: George T. Pinson, Huntsville, Ala.

[73] Assignee: The Boeing Company, Seattle, Wash.

[21] Appl. No.: 343,557

[22] Filed: Jan. 28, 1982

[51] Int. Cl.[3] ..... F02M 31/00; F02M 29/06

[52] U.S. Cl. ..... 123/478; 123/463; 123/590; 123/52 M

[58] Field of Search ..... 123/478, 463, 590, 52 M

[56] References Cited

U.S. PATENT DOCUMENTS

| | | | |
|---|---|---|---|
| 3,650,258 | 3/1972 | Jackson | 123/463 |
| 3,680,536 | 8/1972 | Clark | 123/463 |
| 3,845,746 | 11/1974 | Elsbett | 123/52 M |
| 3,945,349 | 3/1976 | Elsbett et al. | 123/52 M |
| 4,269,156 | 5/1981 | Drellishak | 123/478 |
| 4,285,320 | 8/1981 | Webster et al. | 123/590 |
| 4,318,386 | 3/1982 | Showalter et al. | 123/590 |
| 4,345,561 | 8/1982 | Kondo et al. | 123/478 |
| 4,372,278 | 2/1983 | Smith | 123/478 |
| 4,377,145 | 3/1983 | Nagaishi | 123/478 |

*Primary Examiner*—Raymond A. Nelli

*Attorney, Agent, or Firm*—Edwin H. Crabtree

[57] ABSTRACT

A fuel management system for an autonomous missile or the like. The system controlling engine starts and metering air and fuel to the missile's internal combustion engine during launch and through the entire mission of the missile.

5 Claims, 3 Drawing Figures

FUEL MANAGEMENT SYSTEM FOR AN AUTONOMOUS MISSILE

BACKGROUND OF THE INVENTION

This invention relates to a fuel management system for an internal combustion engine and more particularly but not by way of limitation for managing the control of the air and fuel mixture to the cylinders of an internal combustion engine used in an autonomous missile. While this system is used in conjunction with an autonomous missile it should be appreciated that the system can be used equally well for various types of aircraft, vehicles and equipment requiring the use of an internal combustion engine as a power source.

Heretofore, there have been a number of fuel metering systems used for various types of gasoline engines. These systems vary from a simple carburator and throttle control to a fuel metering and fuel injection technique. None of these systems are entirely satisfactory for use in a missile, since they are generally unable to accomodate the wide range of environmental conditions encountered by the missile. In addition, the missile requires that the system have a very high reliability, the use of a minimum of sensors, be extremely light in weight and must meet size requirements. Prior to the subject invention, a feedback carburator system was used on all known missiles. This system is not satisfactory since it requires manual choking to start the engine and permits only throttle control during flight with some compensation for increased air flow at high altitude.

In U.S. Pat. No. 1,151,159 to Brown, U.S. Pat. No. 2,026,798 to Pogue, U.S. Pat. No. 3,326,538 to Merrit, U.S. Pat. No. 2,012,564 to Holmes and U.S. Pat. No. 3,325,152 to Wahnish various types of carburator and air fuel mixture devices are disclosed.

None of these prior art patents disclose the unique features and advantages of the subject fuel management system as described herein.

SUMMARY OF THE INVENTION

The subject fuel management system provides for a continuously monitoring engine performance with adjustment for both air and fuel flow to optimize fuel economy and engine performance.

The system also monitors engine performance through the adjustment of spark advance or retard control based on the engines RMP and exhaust gas temperature.

The system also includes the automatic mixing of the fuel and air and creating turbulence in a mixer can for creating a complete homogeneous mixture of the fuel and air prior to introducing the mixture to the individual cylinders of the internal combustion engine.

The system also includes the use of flexible tubing lines in supplying the air and fuel to the mixer can. The lines are received through a solenoid housing with the solenoid controlled by the missiles autopilot. By signaling the solenoid the amount of air and fuel is controlled.

As an option the system can use air fuel injectors adapted for attachment to each cylinder of the internal combustion engine for receiving the homogeneous air fuel mixture and injecting the mixture into the cylinders of the engine.

The fuel management system for an autonomous missile or the like having a flight autopilot and for delivering a turbulent air fuel mixture to the cylinders of an internal combustion engine includes an air supply with an air supply line. An air control valve is connected to the air supply line for controlling the flow of air. A fuel supply is connected to a fuel supply line and fuel pump. A fuel control valve is connected to the fuel line for controlling the flow of fuel. An air fuel mixer can is connected to the air and fuel supply lines for receiving the air and fuel and mixing it therein. Intake manifolds are connected to the air fuel mixer can for receiving the mixture of air and fuel and introducing it into the individual cylinders. Pressure sensors are disposed in the intake manifolds and connected to the missile's autopilot for monitoring the pressure of the air fuel mixture introduced into the manifolds.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
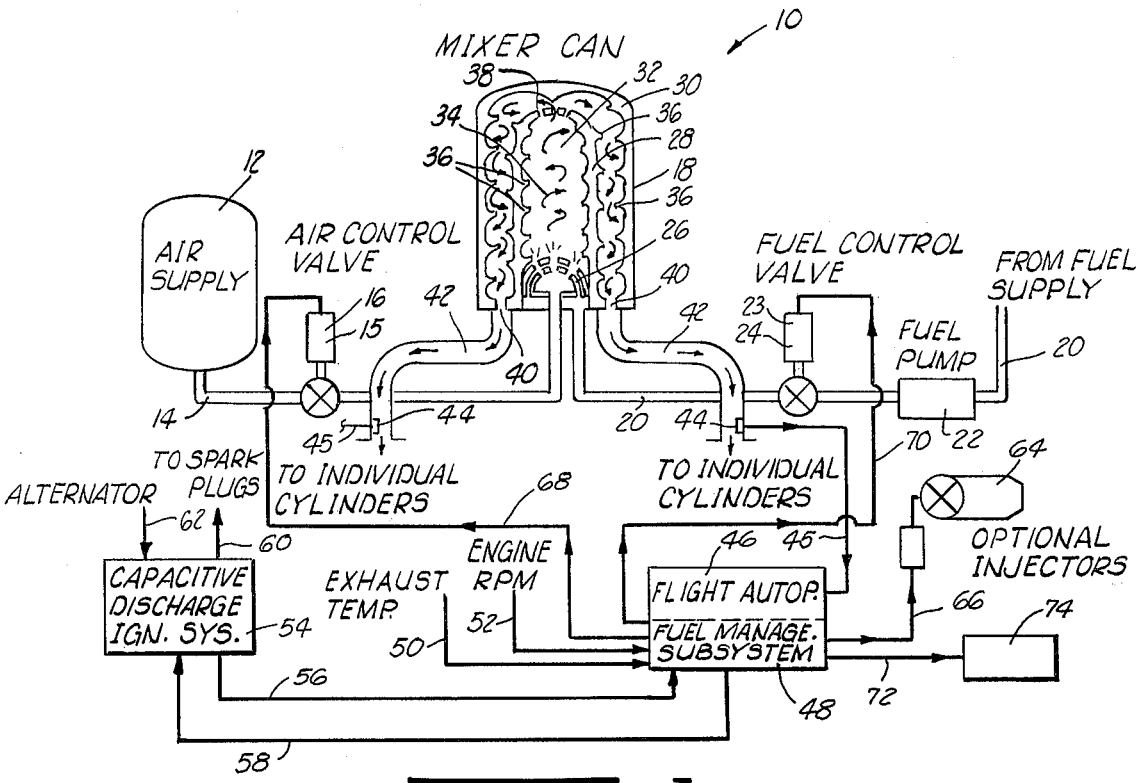
FIG. 1 is a flow diagram illustrating the individual elements of the fuel management system for the autonomous missile.

In FIG. 1 a flow diagram of the fuel management system for an autonomous missile is illustrated and designated by general reference numeral 10. The system 10 includes an air supply 12 connected to a flexible air line 14 which passes through a housing 15 of an air control valve 16 prior to entering the bottom of a mixer can 18. The air control valve 16 will be discussed in greater detail under FIG. 2.

A flexible fuel line 20 is connected to a fuel supply tank which is not shown in the drawings. The fuel line 20 is connected to a fuel pump 22 and from there it is received through a housing 23 of a fuel control valve 24 which is similar in structure to the air control valve 16. The fuel line 20 is received in the bottom of the mixer can 18 and adjacent the air line 14 where the air and fuel are discharged into a fuel atomizing orifice 16. The fuel atomizing orifice 26 is shown in an enlarged front view in FIG. 3 and will be discussed in detail under that drawing.

The mixer can 18 is made up of an inner container 28 and outer container 30. As the air and fuel are introduced and mixed in the fuel atomizing orifice 26, the mixture is discharged upwardly into an inner chamber 32 of the inner container 28. As the mixture raises it contacts vortex generator spirals 36 which are attached to the inner walls of the inner container 28 to produce a turbulent flow as indicated by arrows 34. The mixture is discharged out of openings 38 in the top of the inner container 28 where the mixture flows downwardly between the outer walls of the inner container 28 and the inner walls of the outer container 30. The outer walls of the inner container 28 and the inner walls of the outer container 30 also include vortex generator spirals 36 which continue to aid in producing a turbulent flow for creating a homogeneous mixture of the air and fuel prior to being discharged out discharge openings 40 at the bottom of the outer container 30 where the mixture enters into intake manifolds 42. The intake manifolds 42 are connected to the individual cylinders of the internal combustion engine. It should be noted that inside the intake manifolds 42 are sensors 44 for measuring the manifold pressure therein. The sensors 44 are electrically connected by lines 45 to a flight autopilot 46 of the autonomous missile. The flight autopilot is a microprocessor. The autopilot 46 includes a fuel management subsystem 48 which is an addition to the microprocessor for receiving data such as exhaust temperature from line 50 and engine RMP from line 52. The subsystem 48 also receives data from a capacitive discharge ignition system 54 via line 56 and sends input data into the ignition system 54 via line 58. The ignition system 54 controls a line 60 to the spark plugs and regulates the alternator via line 62.

As an option, the subsystem 48 may be connected to optional fuel injectors 64 via line 66. The injectors 64 can be adapted for receipt in the individual cylinders for receiving the air fuel mixture from the intake manifolds 42.

The control system for the fuel management subsystem 48 can be a part of the autopilot 46. The control parameters used are the engine RPM, the exhaust temperature and the pressure sensors 44. The computations performed by the subsystem 48 considers all factors necessary to manage the fuel mixture and optimize performance. A minimum of sensor input data is required. This reduces the cost and the system complexity. As mentioned above the system 10 receives input data such as the engine RPM via line 52, exhaust gas temperature via line 50, spark control via line 56 and manifold pressure via line 45.

The fuel management subsystem 48 which is part of the autopilot 46 controls the air control valve 16 and fuel control valve 24 via lines 68 and 70. Also connected to the fuel management subsystem via line 72 is a thermal heating blanket 74 or the like which can be used for wrapping around the mixer can 18, autopilot 46 or any other equipment desired in order to maintain the equipment in proper working order should severe environmental conditions occur such as icing.

Figure 2:
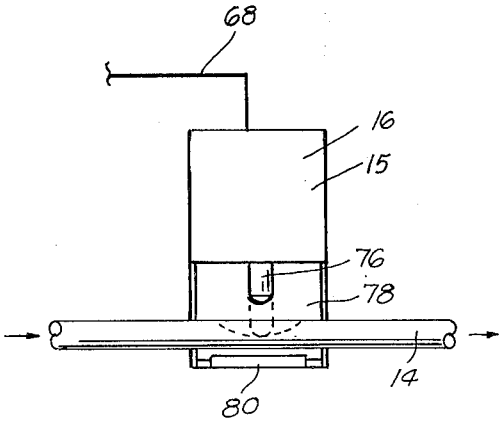
FIG. 2 is a front view of the solenoid housing for receiving the flexible air line and fuel line therethrough.

In FIG. 2 the air control valve 16 is shown connected to the electrical line 68. The control valve 16 is made up of the housing 15 having a solenoid therein and connected to a hammer 76. The lower portion of the housing 18 includes an opening 78 for receiving the line 14 therethrough. Disposed below the line 14 and attached to the housing is an anvil 80. When the solenoid receives a pulse width modulator signal from the subsystem 48 the solenoid responds and the hammer 76 is lowered on top of the flexible air line 14 pinching the line 14 against the top of the anvil 80 thereby restricting the air flow therethrough and accordingly controlling the air flow to the mixer can 30 as required. It should be noted that the air control valve 16 is identical in operation and structure to the fuel control valve 24 with the valve 24 used for controlling the amount of fuel passing through the flexible fuel line 20.

Figure 3:
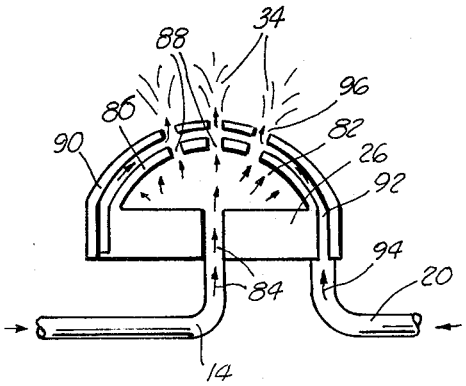
FIG. 3 is an enlarged front view of air and fuel atomizing orifice.

In FIG. 3 the fuel atomizing orifice 26 is shown in greater detail. The orifice 26 includes a central air chamber 82 for receiving the air indicated by arrows 84 therein from the supply line 14. The central air chamber 82 is surrounded by an inner spray head 86 having an inner spray orifices 88 for discharging the air therefrom. Surrounding the inner spray head 86 and in a spaced relationship therefrom is an outer spray head 90 and inner space 92 therebetween for receiving fuel indicated by arrows 94 from the fuel line 20. The fuel is mixed with the air inside the inner space 92 where it, under pressure, is discharged through outer spray orifices 96. From this point, the air fuel mixture circulates upwardly as indicated by arrows 34 as shown in FIG. 1 where the turbulent fuel air mixture is produced prior to the mixture being discharged into the intake manifolds 42.

As mentioned above the fuel management system 10 for an autonomous missile or the like provides a unique method of continuously moderating engine performance with adjustments of both air and fuel flow to optimize fuel economy and engine performance during the entire mission of the missile.

Changes may be made in the construction and arrangement of the parts or elements of the embodiments as described herein without departing from the spirit or scope of the invention defined in the following claims.

What is claimed is:

1. A fuel management system for an autonomous missile or the like, the missile having a flight autopilot microprocessor, the system delivering a turbulent air fuel mixture to the cylinders of an internal combustion engine, the system comprising:

an air supply with an air supply line;

an air control valve connected to the air supply line for controlling the flow of air;

a fuel supply with fuel supply line and fuel pump;

a fuel control valve connected to the fuel line for controlling the flow of fuel;

an enclosed air fuel mixer can having an inner container, an outer container and an atomizing orifice disposed at the bottom of the inner container, the atomizing orifice connected to the air and fuel supply lines for receiving and atomizing the air and fuel therein and discharing the mixture out the top thereof and into the inside of the inner container, the mixture discharged out the top of the inner container and downwardly between the outside of the inner container and the inside of the outer container and through discharge openings in the bottom of the outer container; and manifolds connected to the discharge opening for delivering the air fuel mixture to the cylinders of the internal combustion engine.

2. The system as described in claim 1 wherein the air control valve and the fuel control valve are connected to the missile's autopilot and controlled thereby by monitoring data from the internal combustion engine such as exhaust temperature, engine RPM, and the ignition system.

3. The system as described in claim 2 wherein the air control valve and the fuel control valve include a solenoid housing with a solenoid connected to a hammer, the solenoid receiving a pulse width modulation signal from the missiles's autopilot and an anvil attached to the solenoid housing, the air supply line and the fuel supply line being made of flexible tubing through the solenoid housing between the hammer and the anvil, the lines engaged by the hammer and compressed thereby for restricting the air supply and the fuel supply when the solenoid receives a pulse width modulation signal.

4. The system as described in claim 1 wherein the interior walls of the inner container and the outer walls of the inner cantainer and the inner walls of the outer container all include vortex generator spirals attached thereto for insuring a complete mixture through tubulence of the air fuel as it is discharged from the atomizing orifice and prior to discharging the mixture through the discharge openings to the intake manifolds.

5. The system as described in claim 1 wherein the atomizing orifice includes a central air chamber for receiving air from the air supply line and an inner spray head surrounding the air chamber and having inner spray orifices in the top thereof, an outer spray head surrounding the inner spray head and having an inner space therebetween for receiving fuel from the fuel supply line, the outer spray head having outer spray orifices in the top thereof and indexed with the inner spray orifices for introducing the fuel received in the inner space and mixing it with the air as the air is discharged out the inner spary orifices and through the outer spray orifices.

* * * * *